US010964502B2

(12) United States Patent
Sprague et al.

(10) Patent No.: US 10,964,502 B2
(45) Date of Patent: Mar. 30, 2021

(54) ELECTROMAGNETIC SWITCH WITH STABLE MOVEABLE CONTACT

(71) Applicant: Tesla, Inc., Palo Alto, CA (US)

(72) Inventors: Bennett Sprague, Oakland, CA (US); Ian C. Dimen, San Francisco, CA (US); Scott I. Kohn, Redwood City, CA (US); Andrew Titus, San Francisco, CA (US); Jeffrey G. Reichbach, Belmont, CA (US); Gregory Michael Goetchius, Mountain View, CA (US); Garland Dughi, Castro Valley, CA (US)

(73) Assignee: Tesla, Inc., Palo Alto, CA (US)

( * ) Notice: Subject to any disclaimer, the term of this patent is extended or adjusted under 35 U.S.C. 154(b) by 0 days.

(21) Appl. No.: 16/213,918

(22) Filed: Dec. 7, 2018

(65) Prior Publication Data

US 2019/0108958 A1 Apr. 11, 2019

Related U.S. Application Data

(62) Division of application No. 14/647,777, filed as application No. PCT/US2013/072596 on Dec. 2, 2013, now Pat. No. 10,153,116.

(Continued)

(51) Int. Cl.
*H01H 1/20* (2006.01)
*H01H 50/58* (2006.01)

(Continued)

(52) U.S. Cl.
CPC ..... *H01H 50/58* (2013.01); *H01H 1/06* (2013.01); *H01H 1/20* (2013.01); *H01H 1/2075* (2013.01);

(Continued)

(58) Field of Classification Search
CPC ..... H01H 1/20; H01H 50/546

(Continued)

(56) References Cited

U.S. PATENT DOCUMENTS 3,023,286 A 2/1962 Bourne et al.
6,304,049 B1 10/2001 Fournier (Continued)

FOREIGN PATENT DOCUMENTS

EP 2348521 7/2011
EP 2442343 4/2012

(Continued)

OTHER PUBLICATIONS

International preliminary report on patentability in application PCT/US2013/072596, dated Jun. 16, 2015, 6 pages.

(Continued)

*Primary Examiner* — Ramon M Barrera
(74) *Attorney, Agent, or Firm* — Knobbe, Martens, Olson & Bear, LLP

(57) ABSTRACT

An electromagnetic switch including a first stationary electric contact, a second stationary electric contact, a mechanical contact, and a moveable contact. The electromagnetic switch is configured for reciprocal motion of the moveable contact into and out of contact with the first stationary electric contact and the second stationary electric contact, wherein the moveable contact remains in contact with the mechanical contact (e.g., a non-conducting contact) throughout the reciprocal motion. In various embodiments, the moveable contact is configured so that at the end of the reciprocal motion three contact points occur, and a triangle defined by the three contact points encloses a center of force of the reciprocal motion.

19 Claims, 7 Drawing Sheets

Related U.S. Application Data

(60) Provisional application No. 61/735,128, filed on Dec. 10, 2012.

(51) Int. Cl.
*H01H 1/06* (2006.01)
*H01H 50/54* (2006.01)
*H01H 50/12* (2006.01)
*H01H 50/30* (2006.01)

(52) U.S. Cl.
CPC ..... *H01H 50/12* (2013.01); *H01H 50/546* (2013.01); *H01H 50/305* (2013.01); *H01H 2235/01* (2013.01)

(58) Field of Classification Search
USPC ..... 335/78–86, 132, 196
See application file for complete search history.

(56) References Cited

U.S. PATENT DOCUMENTS

| | | | | |
|---|---|---|---|---|
| 6,781,490 | B2 * | 8/2004 | Funayama | H01H 50/026 335/78 |
| 9,064,664 | B2 | 6/2015 | Yamamoto | |
| 2002/0036557 | A1 * | 3/2002 | Nakamura | H01H 9/40 335/128 |
| 2005/0219018 | A1 | 10/2005 | Schneider et al. | |
| 2006/0261916 | A1 | 11/2006 | Molyneux et al. | |
| 2011/0193662 | A1 | 8/2011 | Swartzentruber et al. | |
| 2012/0092097 | A1 | 4/2012 | Choi | |
| 2012/0092102 | A1 | 4/2012 | Eum | |

FOREIGN PATENT DOCUMENTS

| | | | |
|---|---|---|---|
| JP | 1973106454 | | 3/1973 |
| JP | 1978110051 | | 9/1978 |
| JP | 2005203306 | | 7/2005 |
| JP | 2012199142 | A | 10/2012 |
| JP | 2012212667 | A | 11/2012 |
| WO | 2012128072 | A1 | 9/2012 |

OTHER PUBLICATIONS

International search report in application PCT/US2013/072596, dated Mar. 20, 2014, 9 pages.

* cited by examiner

ELECTROMAGNETIC SWITCH WITH STABLE MOVEABLE CONTACT

CROSS REFERENCE TO RELATED APPLICATION

The present U.S. Utility patent application claims priority pursuant to 35 U.S.C. § 121 as a divisional of U.S. Utility application Ser. No. 14/647,777, entitled "ELECTROMAGNETIC SWITCH WITH STABLE MOVEABLE CONTACT", filed May 27, 2015, scheduled to issue which issued as U.S. Pat. No. 10,153,116 on Dec. 11, 2018, which claims priority pursuant to 35 U.S.C. § 371 as a National Phase Application of PCT/US2013/072596, entitled "ELECTROMAGNETIC SWITCH WITH STABLE MOVEABLE CONTACT", filed Dec. 2, 2013, which claims priority pursuant to 35 U.S.C. § 119(e) to U.S. Provisional Application No. 61/735,128, entitled "STABLE MOVEABLE BUS BAR," filed Dec. 10, 2012, all of which are hereby incorporated herein by reference in their entirety and made part of the present U.S. Utility patent application for all purposes.

BACKGROUND

A variety of applications, such as electric vehicles, require the use of contactors and relays to control the opening and closing of various electric power lines. Under certain conditions, electric vehicles and/or other electric equipment can generate audible noise and/or vibration.

SUMMARY

In a first aspect, an electromagnetic switch includes: at least two stationary electric contacts; and a moveable contact, wherein the electromagnetic switch is configured for reciprocal motion of the moveable contact into and out of contact with the stationary electric contacts, wherein the moveable contact is configured so that at least three contact points occur in the reciprocal motion, and so that a triangle defined by the at least three contact points encloses a center of force of the movement.

Implementations can include any or all of the following features. There are first and second stationary electric contacts and the moveable contact is configured so that the three contact points occur with the stationary electric contacts: first and second contact points occurring on the first stationary electric contact and a third contact point occurring on the second stationary electric contact. The electromagnetic switch is formed from a rectangular metal block having at least one planar surface, wherein the metal block has a first recess in the planar surface to form the first and second contact points, and second and third recesses to form the third contact point. A hole for a shaft passes through the metal block at the center of force, the shaft driving the movement of the moveable contact.

There are first and second stationary electric contacts and at least one non-conducting mechanical contact, and wherein the moveable contact is configured so that a first contact point occurs with the first stationary electric contact, a second contact point occurs with the second stationary electric contact, and a third contact point occurs with the non-conducting mechanical contact. The non-conducting mechanical contact is positioned so that the third contact point occurs at an end of the reciprocal motion, and does not occur during another portion of the reciprocal motion. The electromagnetic switch further includes a heat sink in thermal contact with the non-conducting mechanical contact. The electromagnetic switch further includes another non-conducting mechanical contact that is contacted by the moveable contact at a beginning of the reciprocal motion. The non-conducting mechanical contact is positioned so that the third contact point occurs throughout the reciprocal motion. The electromagnetic switch further includes a heat sink in thermal contact with the non-conducting mechanical contact. The electromagnetic switch further includes another non-conducting mechanical contact, wherein the moveable contact is confined between the mechanical contacts throughout the reciprocal motion. The non-conducting mechanical contact comprises an attachment of the moveable contact to the electromagnetic switch. The attachment comprises a flexure that allows the reciprocal motion. The electromagnetic switch further includes a heat sink in thermal contact with the attachment.

The moveable contact has a substantially triangular shape corresponding to the three contact points. The substantially triangular shape has at least one truncated corner. There are first, second and third stationary electric contacts, and wherein the moveable contact is configured so that at least one contact point occurs with each of the first, second and third stationary electric contacts. The first, second and third stationary electric contacts are positioned so that the contact points occur at an end of the reciprocal motion, and do not occur during another portion of the reciprocal motion. The moveable contact is spring loaded.

The center of force of the movement is located away from a centroid of the triangle defined by the at least three contact points.

Implementations can provide any or all of the following advantages. A contactor in a switch can provide mechanically stable electrical contact by incorporating triangular contact point geometry. Electrodynamic motion or oscillatory instability resulting from large-amplitude currents can be eliminated or reduced.

DETAILED DESCRIPTION

This document describes examples of electromagnetic switches each having a moveable contact subject to reciprocal motion, wherein at least three contact points occur during the reciprocal motion. In some implementations, the moveable contact makes at least three contact points with the stationary contacts that are also part of the electromagnetic switch. In some implementations, two contact points can be made against the stationary contacts, and a third contact point can be made with another contact, such as a non-conducting mechanical contact. The triangle defined by the three contact points encloses the center of force that is driving the movement of the moveable contact. For example, such configurations can eliminate or reduce the noise caused by unwanted resonance that can occur in a moveable contact during use.

Figure 1A:
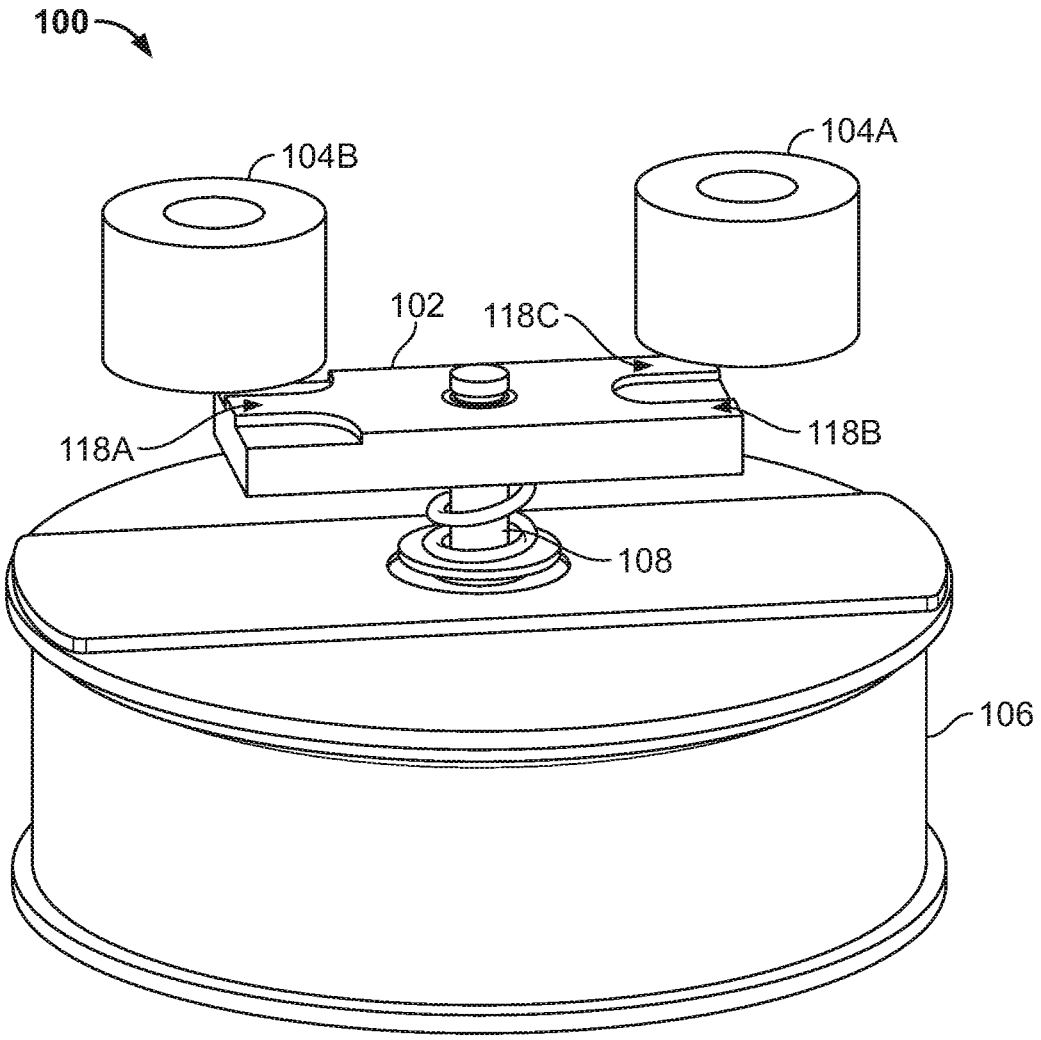
FIGS. 1A-B show an elevated view and a cross section, respectively, of an electromagnetic switch.
Figure 1B:
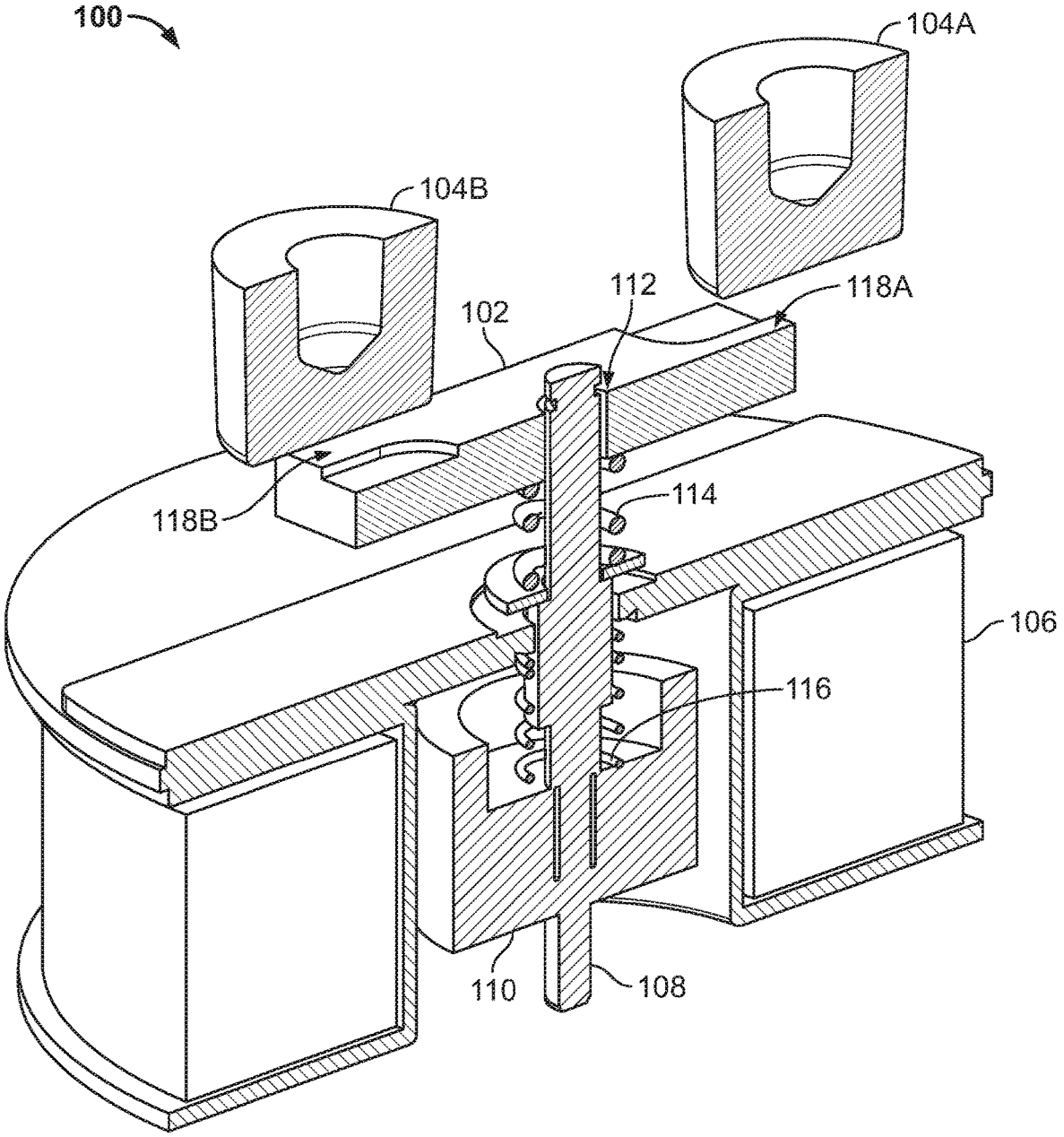

FIGS. 1A-B show an elevated view and a cross section, respectively, of an electromagnetic switch 100. In some implementations, the switch is part of the power electronics of an electric motor. For example, an electric vehicle can have electromagnetic switches in an inverter, where they are used to convert DC from a battery or other storage into AC for driving the motor. In the current example, only one electromagnetic switch is illustrated, and some components thereof are not shown for clarity. Nevertheless, with regard to characteristics or aspects not explicitly mentioned here, the electromagnetic switch can operate similarly or identically to conventional switches.

The electromagnetic switch 100 has a moveable contact 102 that is configured to be moved into and out of contact with stationary contacts 104A-B. For example, the stationary contacts can be considered positive (+) and negative (−) terminals, respectively, of an electric circuit. In a closed position, the moveable contact forms an electric path between the stationary contacts. For example, this can allow a current to flow from one of the stationary contacts to the other.

The electromagnetic switch 100 has a solenoid 106 that actuates a shaft 108. Particularly, the solenoid interacts with an armature 110 that is connected to the shaft 108 inside the solenoid, and thereby drives the shaft in reciprocal motion. The moveable contact 102 is attached to the shaft. For example, an opening 112 for the shaft is formed in the moveable contact. The opening can be a hole that extends through the entire thickness of the moveable contact, as in the current example.

The reciprocal motion of the shaft and the moveable contact can be facilitated by one or more springs. In some implementations, the moveable contact is spring loaded. For example, a helical spring 114 is here placed around the shaft 108 on the outside of the solenoid, between the moveable contact 102 and the top of the solenoid. As another example, a spring 116 is here placed around the shaft on the inside, between the armature 110 and the top of the solenoid.

Figure 2:
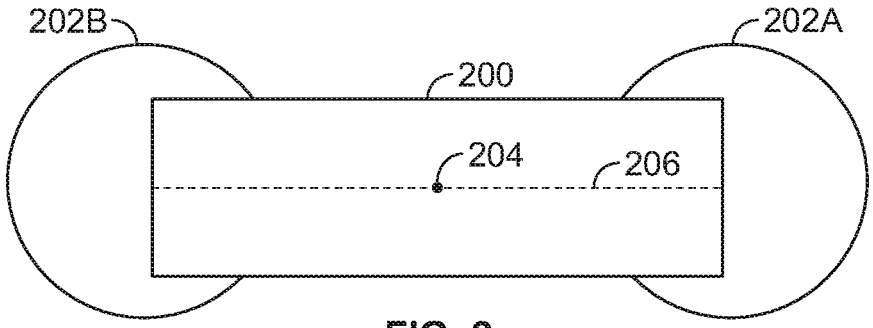
FIG. 2 (Prior Art)
FIG. 2 shows a prior art contact.

FIG. 2 shows a prior art contact 200. The contact 200 is here shown in a closed position, wherein the contact closes a path between respective stationary contacts 202A-B. Each of the stationary contacts can have a non-planar surface facing the contact, such as cylindrical surface with a radius of curvature larger than the dimensions of the contact. The contact is spring loaded and can be moved into and out of contact with the stationary contacts by way of a shaft 204.

When the contact 200 is being used, some undesirable effect(s) can occur. For a variety of reasons, the contact can be subject to resonance or other vibration, which can generate unwanted noise or resistance increase, to name just a few conditions. For example, the contact can vibrate about a longitudinal axis 206 that passes through the shaft 204. Such vibration can be caused, or increased, by torque acting on the contact about the longitudinal axis.

With reference again to FIGS. 1A-B, the moveable contact 102 is configured to form multiple contact points with the stationary contacts 104A-B. For example, the moveable contact can have an area 118A for the stationary contact 104B, and areas 118B-C for the stationary contact 104A. The areas 118A-C are positioned so that the respective contact points are located in particular ways about the shaft 108. Examples of this will now be described.

Figure 3:
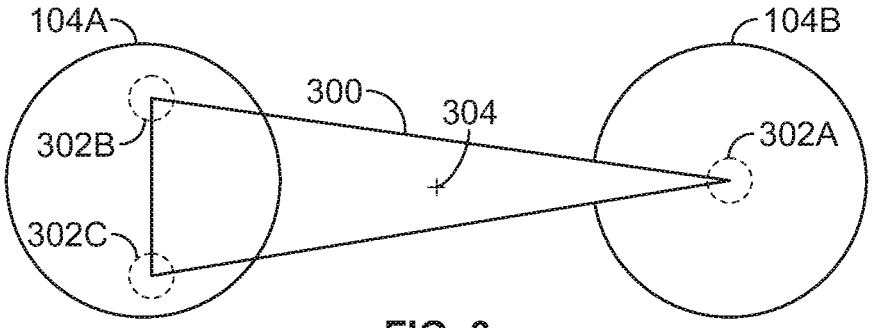
FIG. 3 schematically shows a triangle defined by contact points enclosing a center of force of a movement.

FIG. 3 schematically shows a triangle 300 defined by contact areas 302A-C formed between, on the one hand, the stationary contacts 104A-B, and on the other hand, the moveable contact (not shown for clarity). That is, when the moveable contact 102 (FIGS. 1A-B) is in the closed position, it forms respective contact points with the stationary contacts within the areas 302A-C. Each of the contact points is associated with current flowing between that stationary contact and the moveable contact. In this example, the triangle 300 is an isosceles triangle. In other implementations, the contact points can form another type of triangle. In some implementations, some or all of the moveable contact and the stationary contacts have a finite radius of curvature.

A center 304 indicates where the force acts on the moveable contact. The center 304 is not located directly in between the areas 302B-C, but rather is displaced in the direction toward the area 302A. In some implementations, when the reciprocal movement of the contact is driven by a shaft (not shown), the center 304 coincides with the shaft. As another example, if the driving force acts on the contact in more than one place, the center 304 indicates the center of the force driving the contact.

The center 304 is enclosed by the triangle 300. That is, the moveable contact is configured so that when it forms contact points with the stationary contacts, within the areas 302A-C, these contact points form a triangle that encloses the center of force that is driving the movement of the contact. That is, no two contact points are collinear with the center 304.

In some implementations, the center 304 coincides with a centroid of such a triangle formed by the contact points. In other implementations, the center is situated away from the centroid (yet is enclosed by the formed triangle).

Figure 4:
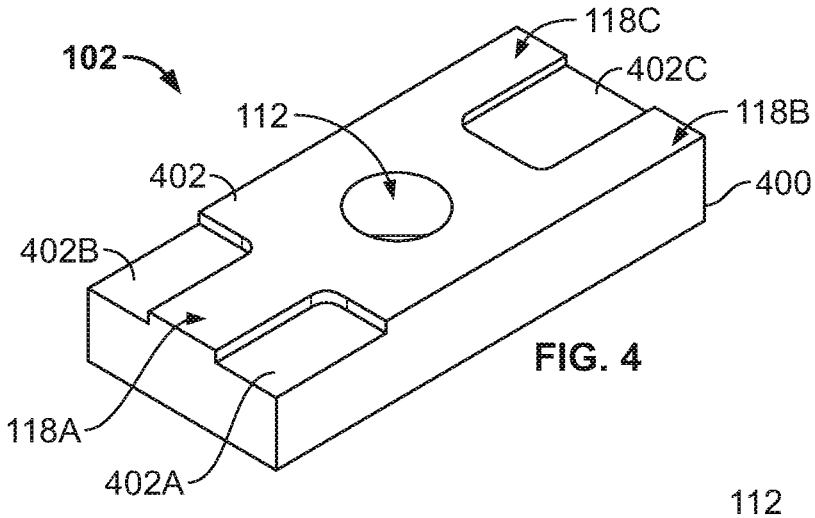
FIG. 4 shows a perspective view of the moveable contact in FIGS. 1A-B.

FIG. 4 shows a perspective view of the moveable contact 102 in FIGS. 1A-B. The moveable contact is formed from a rectangular metal block 400 that has a planar surface 402. Moreover, the metal block has recesses 402A-C formed in the planar surface. The recesses 402A-B are here situated in respective corners at one end of the block, and thereby form the contact area 118A. The recess 402C, in turn, is situated along the short end of the metal block, between the other corners, and thereby forms the contact areas 118B-C. For example, the recesses can be formed by machining the metal block. As another example, the metal block can be cast into the desired shape. Here, the shaft is currently not present in the opening 112.

Figure 5:
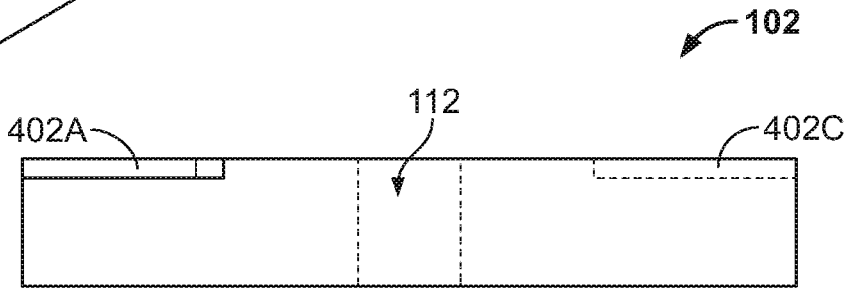
FIG. 5 shows a side view of the moveable contact in FIGS. 1A-B.

FIG. 5 shows a side view of the moveable contact 102 in FIGS. 1A-B. Here, a side of the rectangular metal block is presented, with the recess 402A visible. The recess 402B and the opening 112 are shown in phantom.

The moveable contact can be manufactured with selected characteristics based on the intended implementation. In an exemplary implementation, the contact is made from a conductive material (e.g., metal), has a certain length, width and height, and the recesses have particular dimensions. Any or all of the just mentioned characteristics can be selected based on one or more factors relevant to the implementation. For example, and without limitation, such factors can include: the magnitude(s) of voltage and/or current expected to be used in the switch; the rate of speed and/or force of the reciprocal movement of the contact; the size and/or shape of the top surfaces of the stationary contacts; or the cost of manufacturing and/or materials.

Figure 6:
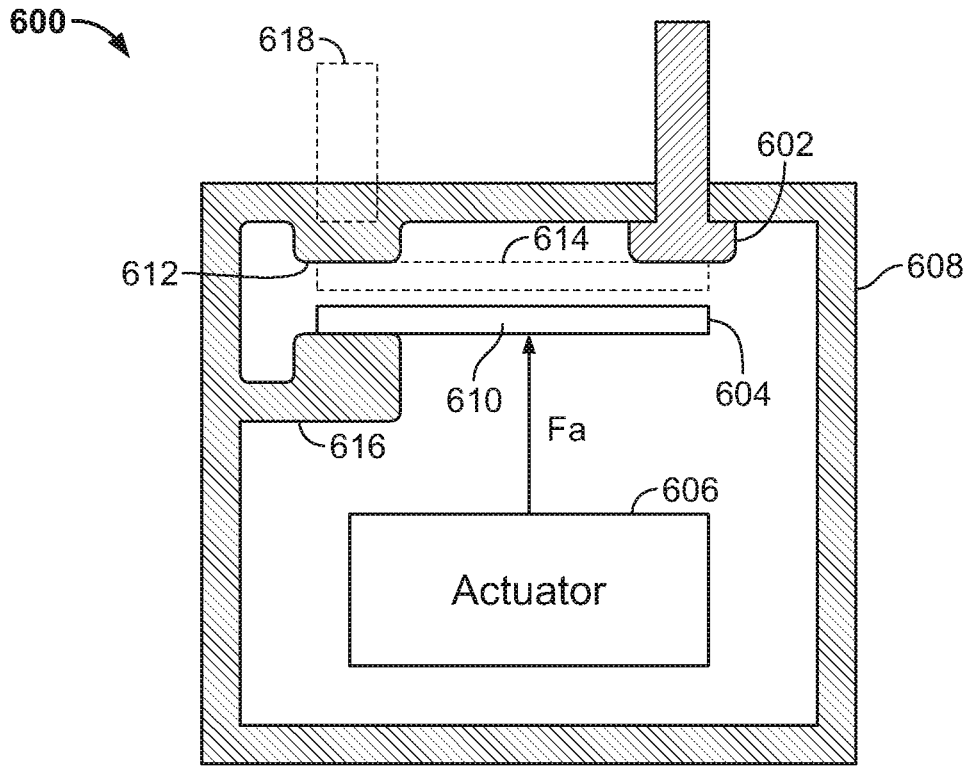
FIG. 6 shows an example of an electromagnetic switch having an additional contact.

FIG. 6 shows an example of an electromagnetic switch 600 having an additional contact. In general, the switch comprises at least two stationary electric contacts 602 having terminals connected to the outside circuit to be closed/interrupted. In the illustrated perspective, one of the stationary electric contacts is positioned behind the other and is therefore currently not visible. A moveable contact 604 is driven in reciprocal motion by an actuator 606, such as a solenoid that acts on a magnet connected to a plunger attached to the moveable contact. The components are mounted on, or contained within, a housing 608, such as an enclosure of a non-conductive material that provides electric insulation toward the exterior and protects the interior from liquid and debris. The actuating force is indicated by $f_a$ and acts upon the movable contact at a point that is sometimes referred to as the center of force.

The electromagnetic switch 600 includes at least one additional contact 612 intended to mechanically stabilize the moveable contact. In some implementations, this is a non-conducting mechanical contact. For example, the mechanical contact can be manufactured from the same material as the housing 608 (e.g., as a protrusion integrally formed on the surface thereof) or from another insulating material. At the end of the reciprocal movement, the moveable contact is at a position 614 where it touches the additional contact 612 as well as both of the stationary electric contacts 602. Accordingly, this creates an electrical connection between at least the stationary electric contacts 602. The presence of the at least three contact points creates an increased stiffness that prevents or reduces the occurrence of oscillations in the moveable contact.

When the actuator 606 moves the moveable contact 604 away from the contacts 602, the electrical connection so created should be interrupted. The moveable contact 604 can be connected to the actuator 606 in ways that are more or less rigid or constrained. For example, when the moveable contact is attached to a shaft, the applicable manufacturing tolerances and/or the properties of the materials involved can provide some play in the attachment of the contact. As a result, the moveable contact may be able to tilt somewhat away from the horizontal plane at one or more phases of the reciprocal motion. If the contact tilts too much, however, it is possible that the contact point with either or both of the stationary electric contacts remains (or re-occurs) as the contact 604 is moving away. If so, the electrical connection many not be fully interrupted, and the switch may not operate to satisfaction.

The moveable contact 604 can be constrained in one or more ways during at least part of the reciprocal motion. In some implementations, a contact 616 can be provided that restricts one end of the movable contact from traveling too far away from the additional contact 612. For example, this can prevent the other end of the moveable contact from touching either of the stationary electric contacts 602. The contact 616 can be attached to the housing 608, or it can be formed as an integral part thereof.

As another example, the moveable contact 604 can be configured so that one of its ends rests on the contact 616 essentially throughout the entire reciprocal motion. In some such implementations, the additional contact 612 can be made less protruding, or omitted entirely.

The additional contact 612 and/or the mechanical contact 616 can be used for one or more other purposes in addition to providing a contact point for the moveable contact 604. For example, the flow of current in the moveable contact 604 results in ohmic heating of the contact and the rest of the electromagnetic switch 600. In some implementations, the switch comprises one or more heat sinks 618 connected to the housing 608 that can serve to remove heat from the switch. This can provide an additional path of thermal contact between the moveable contact and the ambient environment of the switch.

Any suitable type of heat sink can be used, including, but not limited to, an unisolated heat fin extending into the ambient surrounding of the switch. For example, when the additional contact 612 is integrated into the wall of the housing 608 it can be made from a relatively thin wall of material, such that heat from the moveable contact is conducted to the heat sink. That is, the conductor, mass, or exchanger, etc. that comprises the heat sink can be brought into intimate thermal contact with the side of the additional contact that opposes the moveable contact by way of thermally conductive grease, paste, brazed joinery, adhesive, etc. In some implementations, because the heat sink is electrically insulated from the stationary contacts 602, fluid cooling can be facilitated. For example, heat exchange channels can be incorporated into the additional contact(s) to exchange heat from the contact directly into a cooling fluid.

In some examples, the contact 612 and/or 616 is a non-conducting mechanical contact. For example, the contact can be made of any suitable material that is sufficiently insulating considering the electrical and other characteristics of the particular implementation.

In other implementations, however, the contact 612 and/or 616 can be an electric contact. This can increase the number of materials available for the implementation, for example so that the selected material is tougher, has lower friction, is more (or less) thermally conductive, and/or is more impact resistant. The moveable contact 604 then makes contact with at least three separate electric contacts at the end of the reciprocal motion. For example, this can allow one contact to serve as an input and two others to serve as outputs. As another example, two of the electric contacts can be electrically tied (e.g., the additional contact 612 with one of the stationary electric contacts 602). The electric contact can be attached to an insulating housing material in some implementations. In other implementations where the housing includes conducting material, an insulating spacer, fastener or other layer (e.g., adhesive) can be placed between the electric contact and the conductive housing.

Figure 7:
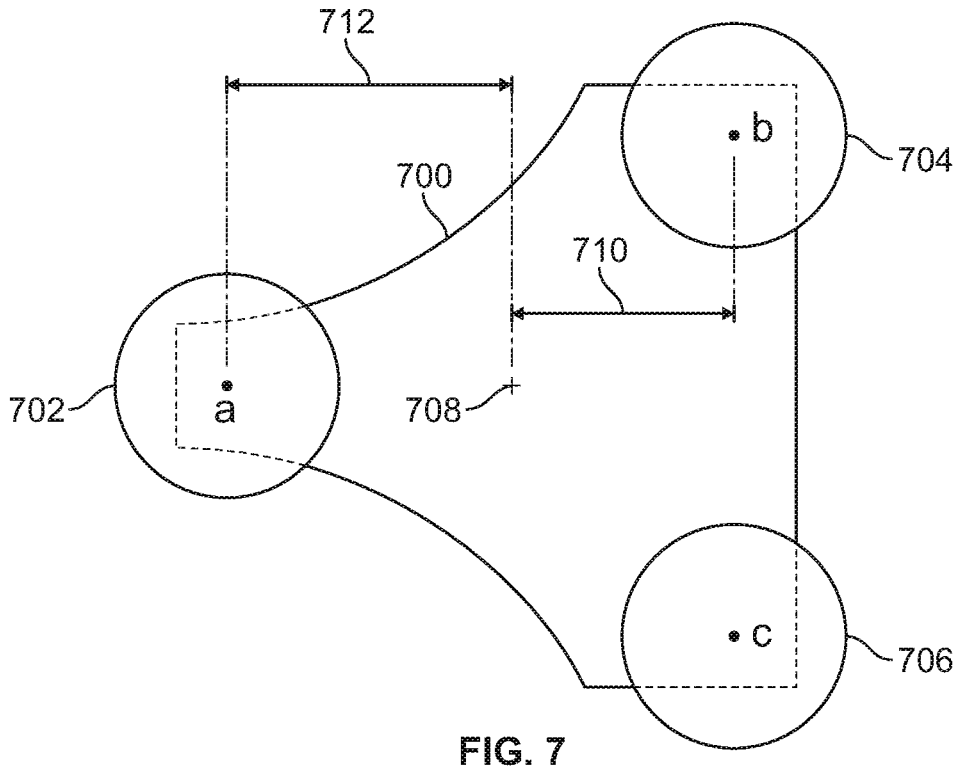
FIG. 7 shows an example of a moveable contact having substantially triangular shape.

FIG. 7 shows an example of a moveable contact 700 having substantially triangular shape. Here, the moveable contact is shown together with stationary contacts 702, 704 and 706, such that at least contact points a, b and c are formed when the moveable contact is driven by an actuator (not shown for clarity) at a center of force 708. For example, the stationary contact 702 can be a non-conducting mechanical contact, and the other two can be electric contacts. As another example, all three of the contacts 702-706 can be electric.

Normally, the center of force 708 is substantially fixed relative to the moveable contact 700 because of the way that the shaft is attached thereto. However, as noted above, the moveable contact can have some freedom of rotation. For example, if the moveable contact rotates about an axis parallel to the line b-c between the contact points b and c, this will cause the contact points b and c to move on the surface of the moveable contact in a direction perpendicular to both b-c and the driving force $f_a$ (e.g., FIG. 6). This rotational movement in combination with the driving force $f_a$ will produce a torque or moment on the moveable contact, the torque measure by a distance 710 between the center of force 708 and the line b-c. For example, the produced force can be a monotonic function of the angular displacement of the moveable contact, and can be oriented so as to tend to restore the moveable contact to angular equilibrium. If zero-slip conditions of surface contact exist between the moveable contact and the stationary contacts 704-706, a translational movement of the moveable contact can also occur in a direction perpendicular to both b-c and the driving force $f_a$ as a result of this rotation.

In some situations, passing a large current between the stationary electric contacts 704 and 706 via the moveable contact will result in a self-sustaining electromechanical excitation of the rocking motion. This has been observed when the current is DC, and it is believed that similar behavior can occur if the current is AC. This motion is deleterious to the performance and life expectancy of the contactor. For example, transient voltage drops across the contacts, and power dissipation in the contactor can degrade the component materials, and transient arcing can lead to redistribution of contact material and degradation of the contact geometry.

Here, the contact point a formed with the contact 702 provides stiffness about the rotational axis of the moveable contact defined by the line b-c, which can prevent or reduce unwanted rotational and/or translational movement. The moveable contact can be configured so that the contact points a, b and c form any suitable shape of triangle, including, but not limited to, an equilateral or an isosceles triangle. The center of force 708 is here located in the interior of the triangle a-b-c. This and other configurations correspond to a rigid body system that is mechanically stable with all three points a, b and c making contact with positive normal force. For example, the center of force 708 is separated from the line b-c by a distance 710; similarly, the center of force is separated from the contact point a by a distance 712. The distances 710 and 712 can be relatively small compared to the distance that the moveable contact travels in the reciprocal motion. In some implementations, the distances 710 and 712 can have different proportions relative to each other.

At the respective corners of the contact points a, b and c, the moveable contact 700 has truncated sides. For example, the truncated sides corresponding to the contact points b and c are here parallel to each other, and are perpendicular to the truncated side of the contact point a. The moveable contact can have edges of a rounded shape between two or more of the truncated sides.

In the above example, the moveable contact has two angular degrees of freedom: rotation about the axis that is parallel to the line b-c and passes through the center of force 708, and rotation about an axis that connects the contact point a with the center of force 708. In some implementations, the required constraints on the motion of the moveable contact can be engineered into the degrees of freedom of the moveable contact itself. For example, the allowed rotation in the above-mentioned axes can be restrained by suitable connection of the moveable contact to the actuator. If the moveable contact is attached to the actuator by way of a drive rod that is constrained to pure linear motion, and that drive rod penetrates a hole in the moveable contact, then an appropriate choice of the dimensional tolerance in the fit between the moveable contact and the drive rod can serve as a constraint. Appropriate consideration should be given to the effect of mechanical wear on said tolerances.

It may also be necessary or desirable to constrain rotary motion of the moveable contact about the axis defined by $f_a$. For example, if the moveable contact is triangular in shape, a constraint can be used to ensure that the contact points between the moveable contact and the stationary contacts are properly formed. For example, a +/−60° rotation of the moveable contact about the $f_a$ axis puts the moveable contactor out of operation. In this embodiment, some form of restraint can be provided by features incorporated into one or more additional (mechanical or electric) contacts, or ancillary features arranged near the contacts (such as posts). On the other hand, if the moveable contact is sufficiently rotationally symmetrical about the center of force, then the contactor will operate correctly in any rotational position. For example, with complete rotational symmetry, the moveable contact is a disc and not triangular.

Figure 8:
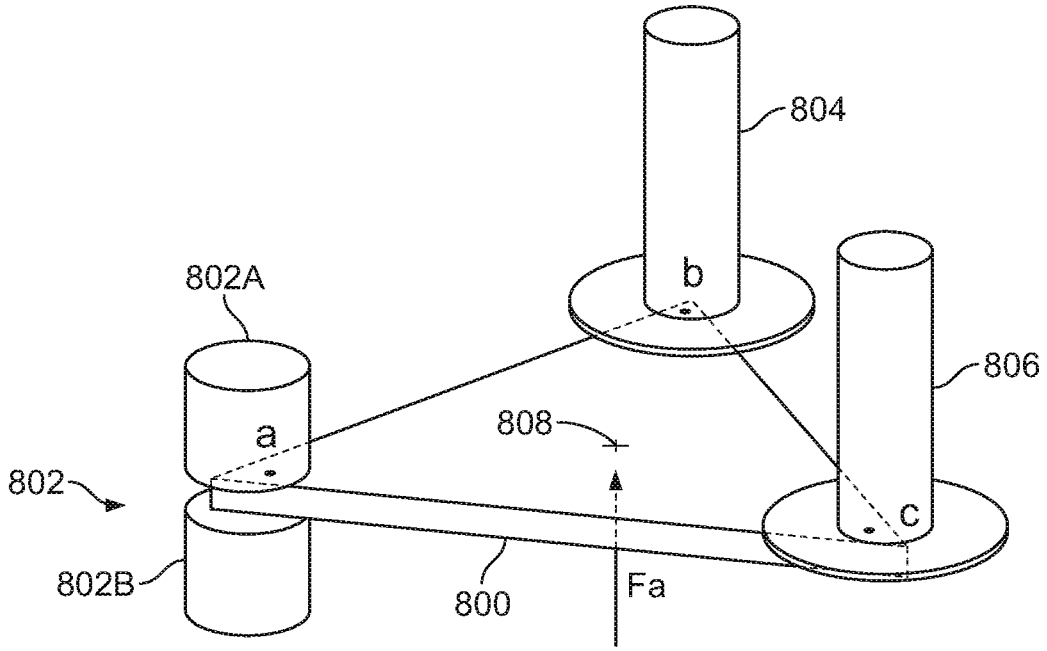
FIG. 8 shows another example of a moveable contact having substantially triangular shape.

FIG. 8 shows another example of a moveable contact 800 having substantially triangular shape. The moveable contact is shown together with stationary contacts 802, 804 and 806, and the contact points are again labeled a, b and c. The moveable contact is driven a center of force 808 by a driving force $f_a$. Here, the corner of the moveable contact where the contact point a is formed is substantially constrained between the stationary contacts 802A-B. For example, the amount of separation between the stationary contacts 802A-B can be chosen based on the relevant thickness of the moveable contact, so that its other side (having the contact points b and c) can travel a certain amount upward and downward as a result of the driving force $f_a$. In this example, the moveable contact has a substantially uniform thickness and forms an isosceles triangle. In some implementations, the contact 802 can be non-conducting and the others electric contacts. In other implementations, all of the contacts 802-806 can be electric contacts.

Figure 9:
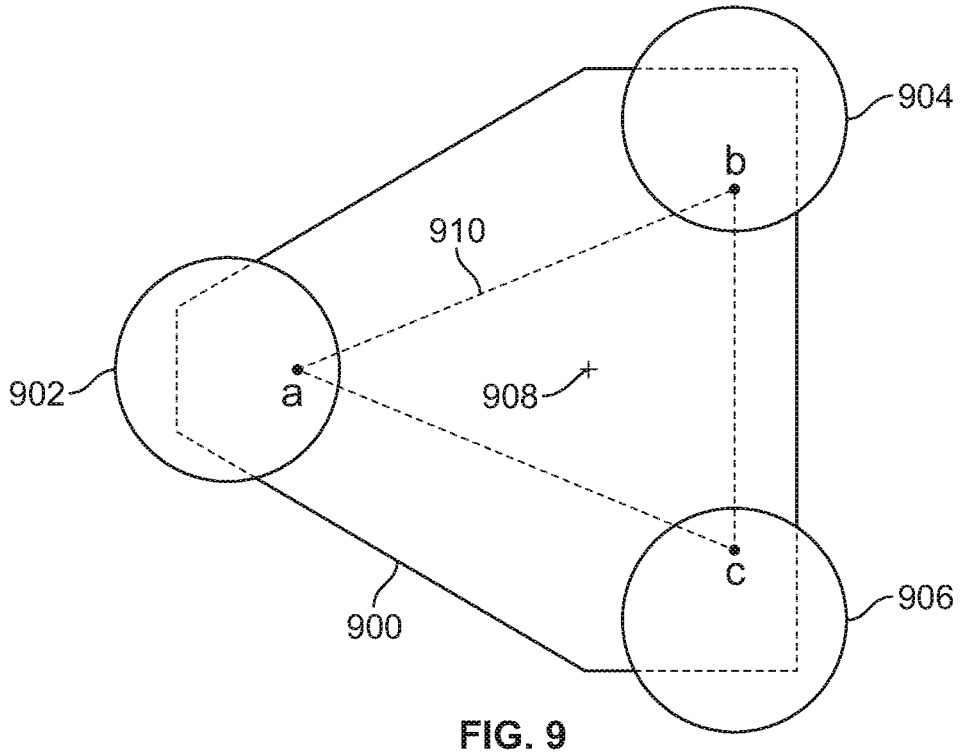
FIG. 9 shows another example of a moveable contact having substantially triangular shape.

FIG. 9 shows another example of a moveable contact 900 having substantially triangular shape. Stationary contacts 902, 904 and 906 are shown. Also indicated are contact points a, b and c and a center of force 908.

At the respective corners of the contact points a, b and c, the moveable contact 900 has truncated sides. For example, the truncated sides corresponding to the contact points b and c are here parallel to each other, and are perpendicular to the truncated side of the contact point a. Also, the moveable contact has straight edges connecting respective ones of the truncated sides to each other.

Mechanical wear and deformation of a contact during use can tend to cause contact points to deviate from their intended, or original, locations. For example, the contact point a is here offset from the center line of the moveable contact and is closer to the contact point b than c. In turn, the contact points b and c have been offset in opposite direction so that they are closer to each other than before. That is, even if each of the contact points was originally essentially centered relative to its respective contact, the contact points have since migrated to the shown locations. However, the moveable contact is configured so that despite such wear/deformation, a triangle 910 formed by the contact points still encloses the center of force 908. This helps maintain the stability and stiffness of the moveable contact.

Figure 10:
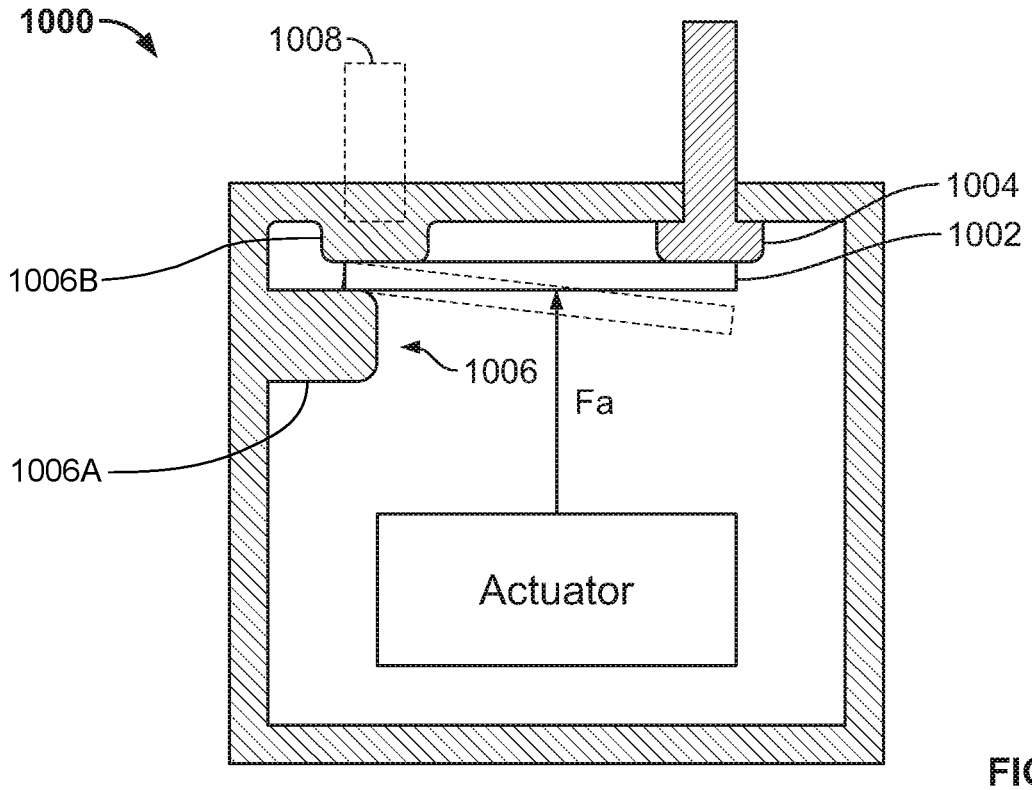
FIG. 10 shows another example of an electromagnetic switch having an additional contact.

FIG. 10 shows another example of an electromagnetic switch 1000 having an additional contact. Here, a driving force $f_a$ causes reciprocating motion of a moveable contact 1002 into, and out of, contact with stationary electric contacts 1004. Another end of the moveable contact is constrained by additional contact 1006. In this example, the additional contact includes portions 1006A-B, both of which are formed as part of the housing of the switch. The switch can have a heat sink 1008 near the additional contact. In some implementations, the additional contact 1006 is an electric contact.

Figure 11:
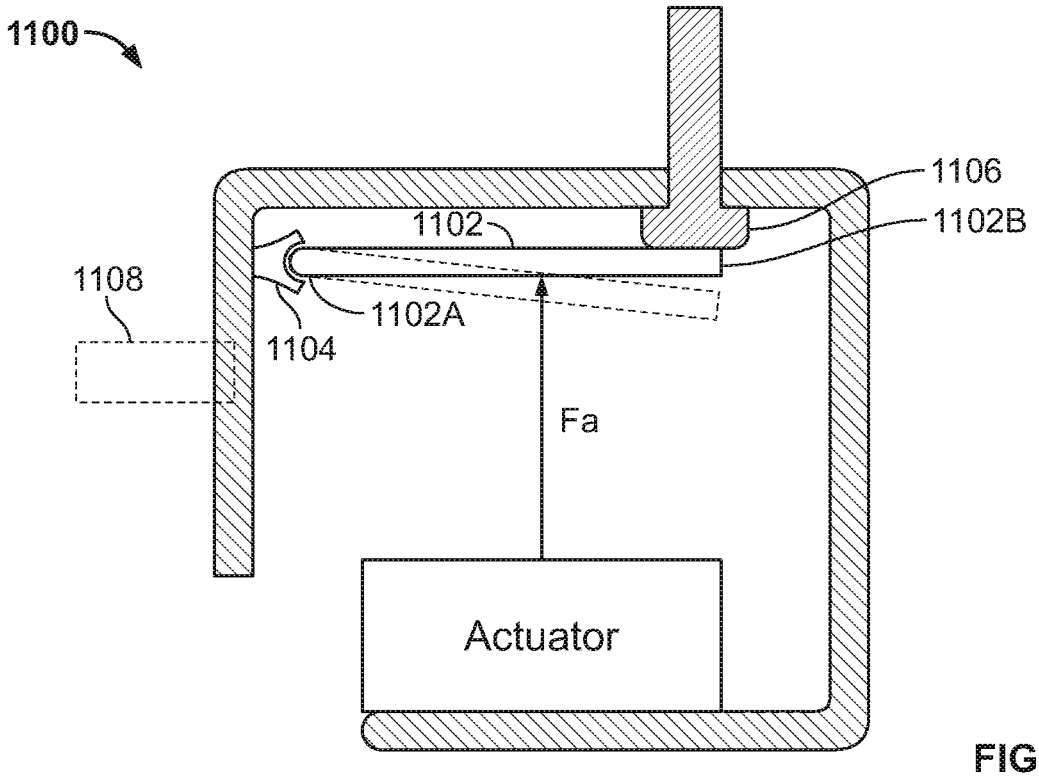
FIG. 11 shows an example of an electromagnetic switch wherein a moveable contact is attached by a ball-and-socket joint.

FIG. 11 shows an example of an electromagnetic switch 1100 wherein a moveable contact 1102 is attached by a ball-and-socket joint 1104. Similar to previous examples, an actuator applies a driving force $f_a$ to move the moveable contact against stationary electric contacts 1106. In this example, one end 1102A of the moveable contact has a rounded shape that at least in part corresponds to the shape of the socket of the joint, which allows one or more other ends 1102B of the moveable contact to reach the stationary contact(s) during the reciprocal motion. The socket of the ball-and-socket joint 1104 can be manufactured as a separate component that is then attached to the housing of the switch, or it can be an integral part that is formed in the manufacturing of the housing. In some implementations, the ball-and-socket joint has the opposite orientation so that the moveable contactor forms the socket part and the ball part is formed by the housing. In some implementations, the ball-and-socket joint is an electric contact. A heat sink 1108 can be provided near the ball-and-socket joint.

Figure 12:
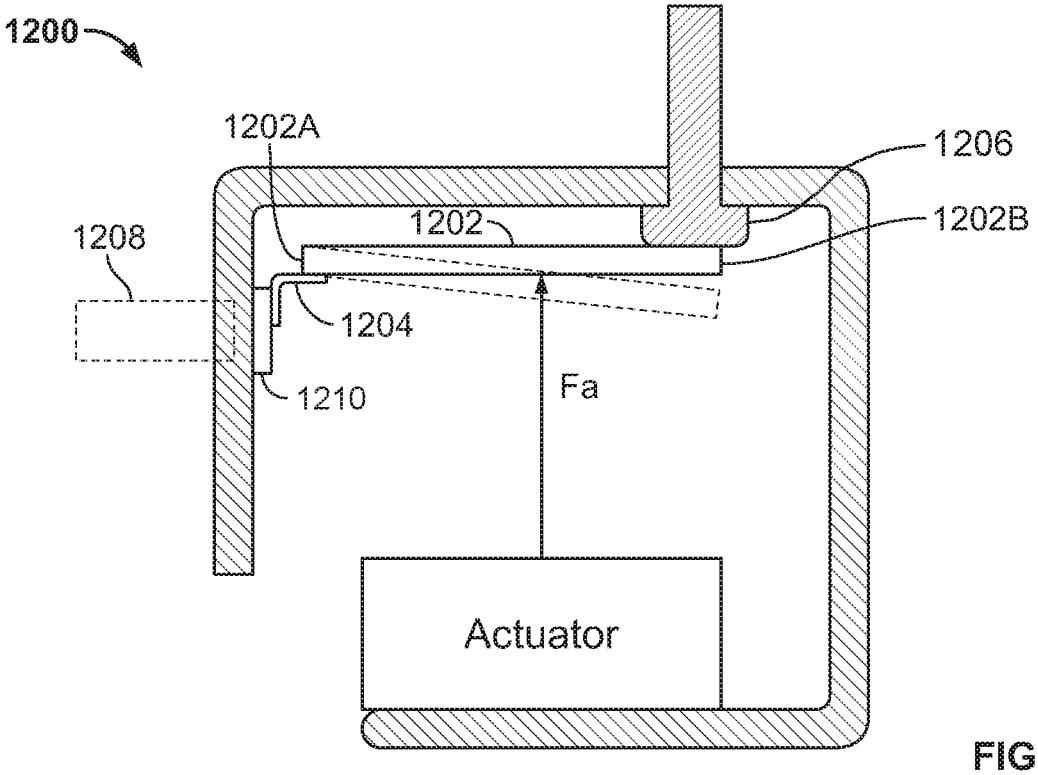
FIG. 12 shows an example of an electromagnetic switch wherein a moveable contact is attached by a flexure.

FIG. 12 shows an example of an electromagnetic switch 1200 wherein a moveable contact 1202 is attached by a flexure 1204. The moveable contact is driven against stationary electric contacts 1206 by a driving force $f_a$. In this example, the flexure 1204 is attached at one end 1202A of the moveable contact, which allows one or more other ends 1202B of the moveable contact to reach the stationary contact(s) during the reciprocal motion. The flexure can be made of any suitable material, such as metal (e.g., steel or bronze). The flexure can be attached to a base 1210 on the housing. The base 1210 can be a non-conducting protrusion on the housing, or it can be an electric contact. A heat sink 1208 can be provided near the flexure.

Figure 13:
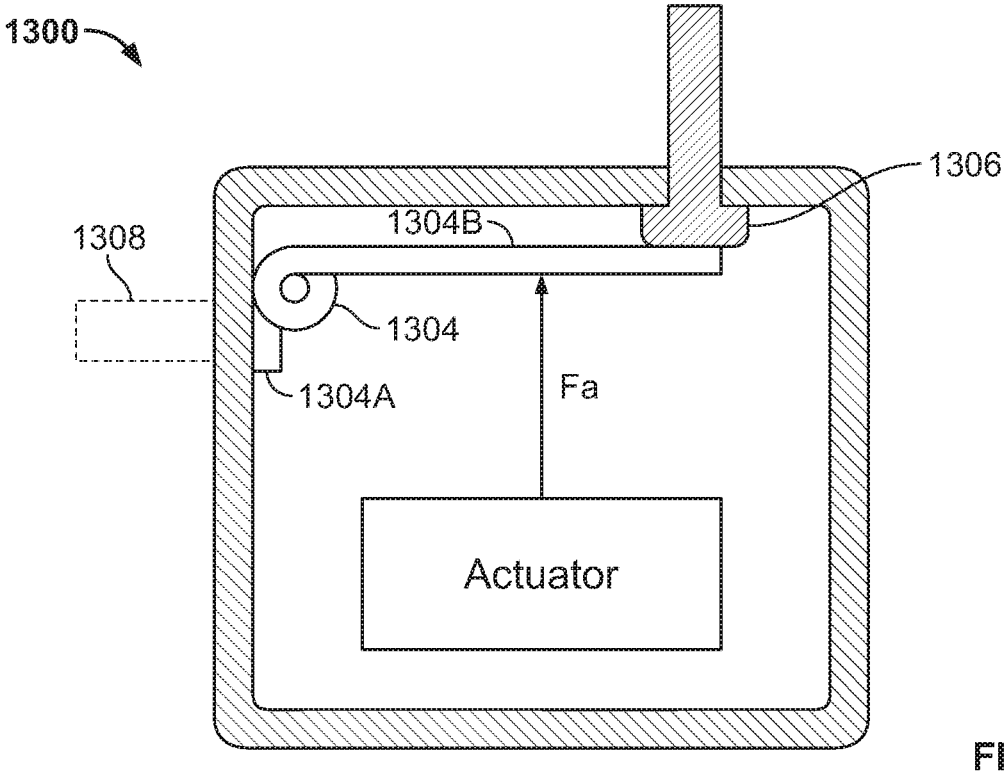
FIG. 13 shows an example of an electromagnetic switch wherein a moveable contact is attached by a hinge.

FIG. 13 shows an example of an electromagnetic switch 1300 wherein a moveable contact 1302 is attached by a hinge 1304. The moveable contact is driven against stationary electric contacts 1306 by a driving force $f_a$. In this example, the hinge is integrally formed with the moveable contact. That is, one end 1304A of the hinge is attached to the housing, and another end 1304B extends to a certain length to form the moveable contact. Any suitable material can be used for the hinge, such as steel, and the material dimensions (e.g., thickness) will be selected based on the specific implementation. In some implementations, the hinge 1304 is an electric contact. A heat sink 1308 can be provided near the hinge.

In some implementations, thermal contact between the moveable contact and one or more additional contacts can be enhanced in one or more ways. Such ways include, but are not limited to: providing complementary surface radii; allowing a small gap under the allowed directions of motion (e.g., as in ball-and-socket features); providing retained grease, liquid, or paste that allows conduction or enhanced convection between the surfaces; providing small repeating ridges, pockets, channels, or the like that enhance convective exchange by the fill gas of the contactor by confining convection to defined length scales; providing flexural connections such as a spring made of a thermally conductive material; and incorporating a phase change fluid in the joint between the moveable contact and one or more other contacts, to create a heat-pipe effect, to name just a few examples.

When opening an electromagnetic switch under load, electrical arcs can occur. It may be necessary or desirable to incorporate one or more permanent magnets into the switch so that its/their field tends to blow these electrical arcs away from the conductors by way of the Lorentz force. In some implementations, one or more such magnets can be placed so that there is no interference with the operation of the moveable contact.

A number of implementations have been described as examples. Nevertheless, other implementations are covered by the following claims.

What is claimed is:

1. An electromagnetic switch comprising:

a first stationary electric contact;

a second stationary electric contact;

a mechanical contact; and a moveable contact continually electrically connected to the second stationary electric contact and configured for reciprocal motion of the moveable contact into and out of contact with the first stationary electric contact, wherein the moveable contact is configured so that at an end of the reciprocal motion:

a first contact point occurs with the first stationary electric contact;

a second contact point occurs with a third stationary electric contact;

a third contact point occurs with the mechanical contact; and a triangle defined by the first contact point, the second contact point, and the third contact point encloses a center of force of the reciprocal motion, wherein the moveable contact remains in contact with the mechanical contact throughout the reciprocal motion.

2. The electromagnetic switch of claim 1, wherein an end of the moveable contact is constrained by the mechanical contact throughout the reciprocal motion.

3. The electromagnetic switch of claim 2, wherein the moveable contact and the second contact point are electrically connected at a ball-and-socket joint.

4. The electromagnetic switch of claim 1, wherein the mechanical contact partially rotates about the third contact point.

5. The electromagnetic switch of claim 1, wherein the moveable contact rotationally couples to the mechanical contact.

6. The electromagnetic switch of claim 1, wherein the mechanical contact comprises an attachment of the moveable contact to the second stationary electric contact by a hinge.

7. The electromagnetic switch of claim 1, wherein the mechanical contact comprises an attachment of the moveable contact to the second stationary electric contact by a flexure.

8. The electromagnetic switch of claim 6, further comprising a heat sink in thermal contact with the attachment.

9. The electromagnetic switch of claim 1, wherein the mechanical contact is a non-conducting contact.

10. The electromagnetic switch of claim 1, wherein the mechanical contact is an electrically conducting contact at the end of the reciprocal motion.

11. The electromagnetic switch of claim 1, further comprising a heat sink in thermal contact with the mechanical contact.

12. The electromagnetic switch of claim 1, wherein the first stationary electric contact is positioned so that the first contact point occurs at the end of the reciprocal motion, and does not occur during another portion of the reciprocal motion.

13. The electromagnetic switch of claim 1, wherein the moveable contact is spring loaded.

14. The electromagnetic switch of claim 1, wherein the center of force of the reciprocal motion is located away from a centroid of the triangle defined by the first contact point, the second contact point, and the third contact point.

15. The electromagnetic switch of claim 1, further comprising a heat sink located adjacent to the second stationary electric contact.

16. The electromagnetic switch of claim 1, wherein the moveable contact is formed from a metal block having at least one planar surface, and wherein the metal block has a first recess in the planar surface to form the first and second contact points.

17. The electromagnetic switch of claim 16, wherein a hole for a shaft passes through the metal block at the center of force, the shaft driving the reciprocal motion of the moveable contact.

18. The electromagnetic switch of claim 1, wherein the moveable contact has a substantially triangular shape.

19. The electromagnetic switch of claim 18, wherein the substantially triangular shape has at least one truncated corner.

* * * * *